United States Patent [19]

Stein et al.

[11] Patent Number: 4,674,132

[45] Date of Patent: Jun. 23, 1987

[54] SURGICAL GOWN

[76] Inventors: Scott Stein, 501 N. Riverside, Apt. 503, Pompano Beach, Fla. 33062; Walter Pyborn, 201 N.W. 32nd Court, Pompano Beach, Fla. 33060

[21] Appl. No.: 932,271

[22] Filed: Nov. 19, 1986

[51] Int. Cl.[4] ..... A41D 9/00

[52] U.S. Cl. ..... 2/114

[58] Field of Search ..... 2/114, 52, DIG. 7

[56] References Cited

U.S. PATENT DOCUMENTS

| | | | |
|---|---|---|---|
| 2,421,195 | 5/1947 | Goldsmith | 2/52 |
| 3,754,284 | 8/1973 | Hartigan et al. . | |
| 3,803,640 | 4/1974 | Ericson . | |
| 3,824,625 | 7/1974 | Green . | |
| 3,864,752 | 2/1975 | Hartigan . | |
| 4,000,521 | 1/1977 | Zoephel et al. | 2/114 |
| 4,075,716 | 2/1978 | Collins . | |
| 4,255,818 | 3/1981 | Crowley et al. . | |
| 4,326,300 | 4/1982 | Bolton et al. . | |
| 4,395,782 | 8/1983 | Reynolds . | |

*Primary Examiner*—Doris L. Troutman

[57] ABSTRACT

An improved surgical gown which can be donned without the assistance of a second party and which offers 360° of sterile protection and includes a malleable semicircular wire and cardboard frame in the neck and upper chest region of the gown and includes an extension of the posterior/anterior flap element of the conventional wrap-around gown and the placement of moisture resistant adhesive strips on the extension so as to close the gown. A belt is provided which has adhesive strips on either side and which can be fastened temporarily to a sterile surface for donning the gown. The user after attaching such belt to a final surface pivots 360° and then attaches the extension to close the gown at a point that meets his standards of techniques and comfort.

7 Claims, 10 Drawing Figures

SURGICAL GOWN

BACKGROUND OF THE INVENTION

1. Field of The Invention

The present invention relates in general to surgical gowns and in particular to an improved surgical gown which can be donned without the assistance of a second party.

2. Description of the Prior Art

Disposable surgical gowns are known, but all of such known gowns require the assistance of a second party to assist in donning of the gown. There are times, however, when it is very inconvenient if not dangerous for a person donning a surgical gown to have to wait until a second person is available to assist him to don the gown and tie him up. At times, a second person is not available which has previously required the surgeon to just wait until someone is available and under common emergency-split second conditions delays can result in crisis and tragedy situation.

SUMMARY OF THE INVENTION

The present invention provides an improved surgical gown which can be donned by the surgeon completely without the assistance of a second party such as a surgical nurse, technologist, other surgeons and so forth.

The function of the present gown design eliminates the present need for a second person to assist the surgeon, nurse or technologist in efficiently donning their sterile surgical gowns. A feature of the gown is provided in that one, a malleable circular wire and cardboard frame is mounted in the neck/upper chest region of the gown. Two, an extension of the posterior/anterior flap element of the "standard" wrap-around design is made and three, the strategic placement of moisture resistant adhesive strips on the extension which allow for mechanical closing of the gown.

So as to don the gown, the following steps are used by the surgeon:

1. The surgical person requiring a sterile gown opens his/her gown places it on the sterile field and then proceeds to surgically clean his/her hands and arms and the gown could have been placed in advance on an already existing sterile field by a member of the overall support team.

2. Then using standard techniques, the person dons the upper portion of the gown of the invention and the wire/cardboard frame structure at the collar greatly simplify and facilitate such donning of the gown.

3. After donning surgical gloves by standard technique, the person donning the gown grasps the conveniently placed adhesive strip on the most distal end of the belt portion and removes the backing of this strip and applies the strip to any sterile surface. The person then pivots or turns 360° counterclockwise and then grasps the strip he has just applied to the sterile surface and removes the backing of the final adhesive strip and he attaches that strip to the point on his gown that meets with his standards of a technique and comfort and then proceeds about the surgical business at hand.

It is a feature of the present invention that a person required to don a surgical gown can do so by himself and without the assistance of a second party, thus, a surgical gown can be donned completely by a person without any assistance.

Other objects, features and advantages of the invention will be readily apparent from the following description and claims when read in view of the drawings in which:

DESCRIPTION OF THE PREFERRED EMBODIMENTS

Figure 1:
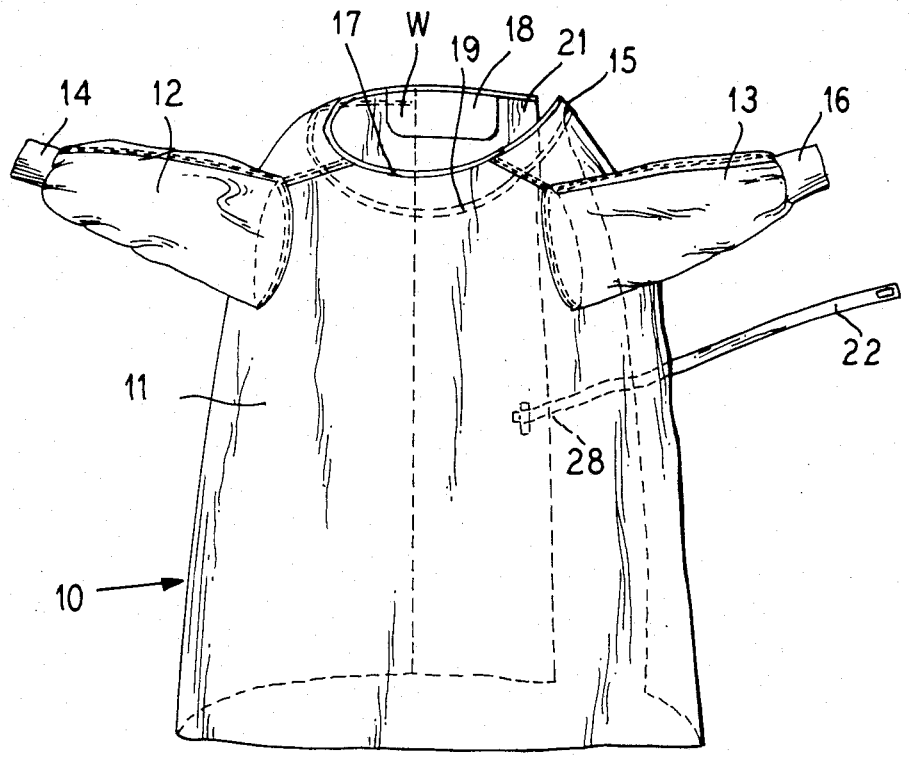
FIG. 1 is a front view of the surgical gown of the invention.
Figure 2:
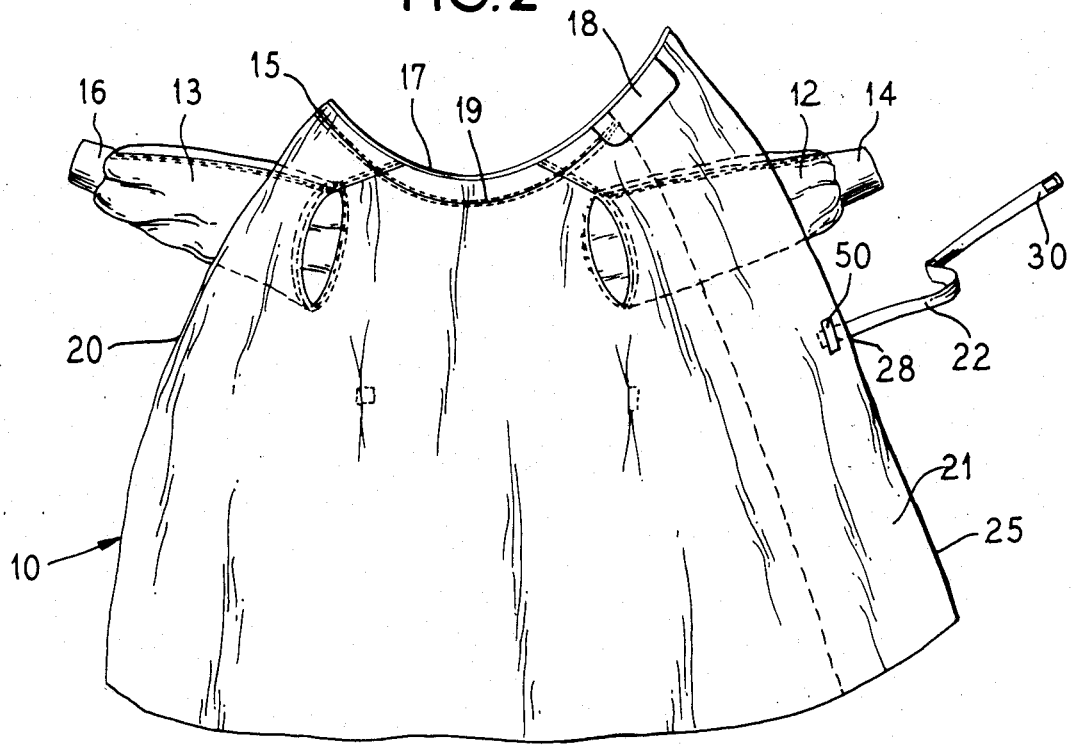
FIG. 2 illustrates the invention from the rear side.

FIG. 1 is a front view of the surgical gown of the invention and FIG. 2 is a view of the surgical gown from the backside. The gown 10 comprises a body portion 11 which is closed at the front and is provided with sleeves 12 and 13 which have cuffs 14 and 16. About the collar 17 and spaced therefrom a distance which might vary from about an inch at the end 15 to about three inches at the middle is mounted a wire 19 that is sewed or otherwise attached to the fabric of the gown. The end W of the wire which is remote from the end 15 terminates in a reinforcing panel 18 of cardboard or of plastic which is attached to the gown and provides flexibility so it conforms to the various human shoulder widths of the users.

An extension panel 21 is attached to the edge of the gown as shown in rear view 2 on the right side of the gown. It is to be realized, of course, that the extension 21 may be integrally formed with the gown, but the extension comprises material which differs from prior art gowns in that prior art gowns are symmetrical rather than having an extension such as extension 21.

Figure 9:
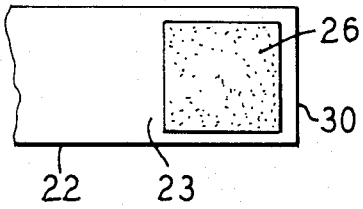
FIG. 9 illustrates one side of the belt with a first adhesive strip.
Figure 10:
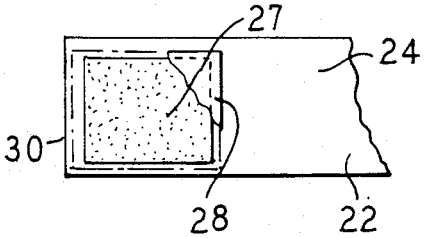
FIG. 10 illustrates the other side of the belt with the second adhesive strip.

A belt 22 is attached to the edge 25 of the extension 21 at point 28 and has a second end 30 which is shown in greater detail in FIGS. 9 and 10. As shown in FIG. 9, on a first side 23 of the belt 22 is a first pressure adhesive 26 formed adjacent the end 30 which initially attaches the end 30 of the belt 22 to the front portion of the gown 10 as illustrated, for example, in FIGS. 3 and 4.

On the second side 24 of the belt 22 adjacent the end 30 is formed a second adhesive strip 27 which is covered by protective layer 28 as shown in FIG. 10.

In use, the gown is donned in the following manner.

1. The surgical person requiring a sterile gown opens his or her gown and places it on the sterile field 40 and then proceeds to surgically clean his/her hands and arms.

2. He then uses standard techniques to don the upper portion of the gown and the wire 19 and frame member 18 facilitate the easy donning of the gown without assistance.

3. He then dons surgical gloves using standard technique and removes the end 30 of belt 22 from the gown and removes the protective layer 28 from adhesive strip 27 and applies the end 30 of the belt 22 to the sterile surface 40 where the adhesive strip 27 firmly holds it. He then pivots or turns 360° counterclockwise. He then grasps the strip he has just previously applied to the sterile surface 40 and then removes the backing on a final strip 50 attached to the gown 10 adjacent the edge 25 of the extension 21 as illustrated in FIG. 2. He attaches the final strip 50 to the point on the gown 10 which is comfortable for him and he is then ready to proceed with the surgical procedure.

Figure 3:
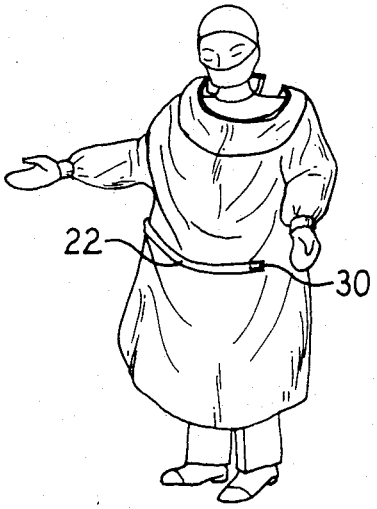
FIGS. 3 through 8 illustrate the technique for donning the gown.
Figure 4:
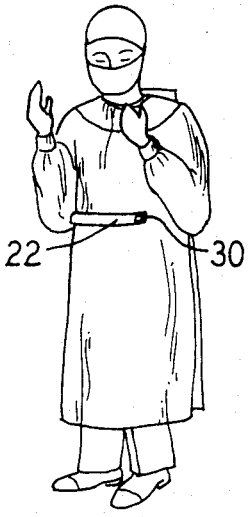
Figure 5:
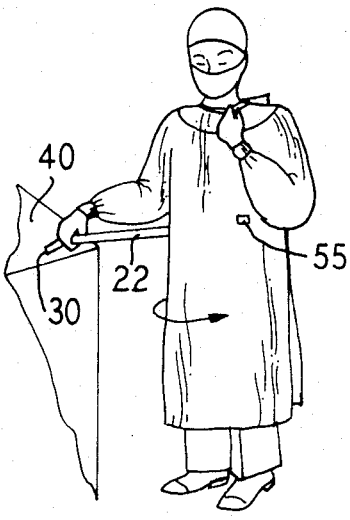
Figure 6:
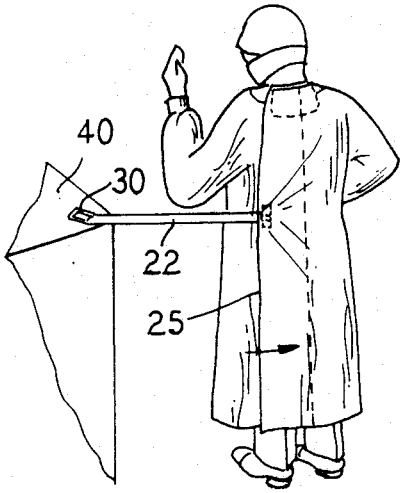
Figure 7:
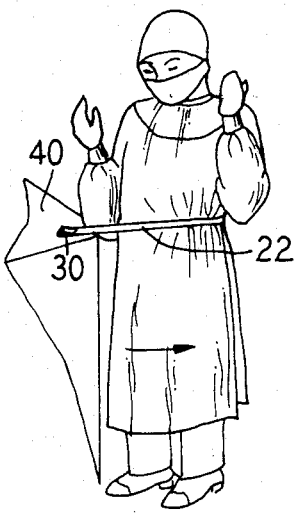
Figure 8:
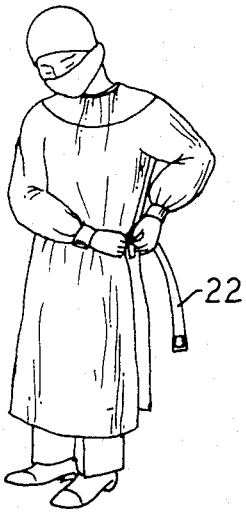

FIGS. 3–8 illustrate the manner of donning the gown. FIG. 3, for example, shows the surgical person immediately after having donned the gown by extending his arms through the sleeves 12 and 13. FIG. 4 illustrates the position of the gown after the wire 19 and reinforcing member 18 have caused it to substantially conform to his neck. FIG. 5 illustrates removing the strip 26 on the first side 23 of the belt 22 from an attachment flap 55 on the gown 10 and attaching it to the sterile surface 40 with adhesive strip 27. In FIG. 5 after attaching the end 30 of the belt 22 to the sterile surface 40, the person rotates 360° to the position shown in FIG. 6 and due to the rotation, the belt 22 has caused the edge 25 to overlap the edge 20 of the gown. FIG. 7 illustrates completion of the rotation of the user and he then removes the end 30 from the sterile surface 40 and removes a backing layer from the surface of an inside layer of adhesive 50 on the inside of the extension 21 as illustrated in FIG. 2 and then presses the adhesive to the surface of the gown to secure it as shown in FIG. 8.

Thus, the present invention allows a person to don a surgical gown without the assistance of a second person. The gown of the invention offers 360° sterile protection.

Although the invention has been described with respect to preferred embodiments, it is not to be so limited as changes and modifications can be made which are within the full intended scope of the invention as defined by the appended claims.

We claim as our invention:

1. A disposable surgical gown which can be donned without assistance comprising, a body portion formed with a front and first and second side portions and a pair of sleeves, a collar opening formed in said body portion and a flexible spring member attached to said body portion about said collar so as to facilitate donning said gown and means for closing said gown by attaching one of said side portions to said body portion.

2. A disposable surgical gown according to claim 1 wherein said flexible spring member has a first end which extends to a first edge of said body portion, and a reinforcing panel attached to a second end of said flexible spring member and said reinforcing panel attached to said body portion adjacent a second edge of said body portion.

3. A disposable gown according to claim 1 including a belt with a first end attached to a side edge of said first side portion, means for temporarily attaching a second end of said belt to a sterile surface, and means for closing said gown by attaching said first side panel to said body portion.

4. A disposable gown according to claim 3 wherein said means for temporarily attaching said belt to said sterile surface is a first pressure sensitive tape mounted on a first side of said belt.

5. A disposable gown according to claim 4 wherein said means for closing said gown is a second pressure sensitive tape.

6. A disposable gown according to claim 5 including a third pressure sensitive tape mounted on a second side of said belt to allow said belt to be initially attached to said body portion.

7. A disposable gown according to claim 3 wherein said first side portion to which said belt is attached is wider than said second side portion.

* * * * *